United States Patent [19]

Cobbs

[11] 4,165,903

[45] Aug. 28, 1979

[54] MINE ENHANCED HYDROCARBON RECOVERY TECHNIQUE

[76] Inventor: James H. Cobbs, 5021 S. Fulton St., Tulsa, Okla. 74135

[21] Appl. No.: 875,427

[22] Filed: Feb. 6, 1978

[51] Int. Cl.[2] ..... E21C 41/10

[52] U.S. Cl. ..... 299/2; 166/278; 299/19

[58] Field of Search ..... 299/2, 11, 12; 166/278

[56] References Cited

U.S. PATENT DOCUMENTS

| | | | |
|---|---|---|---|
| 1,634,235 | 6/1927 | Ranney | 299/2 |
| 1,634,236 | 6/1927 | Ranney | 299/2 |
| 1,660,187 | 2/1928 | Ehrat | 299/2 |
| 1,735,481 | 11/1929 | Uren | 299/2 |
| 1,811,561 | 6/1931 | Ranney | 299/2 |
| 1,935,643 | 11/1933 | Laughlin | 299/2 |
| 2,083,625 | 5/1937 | White | 166/278 X |
| 3,950,029 | 4/1976 | Timmins | 299/11 X |

*Primary Examiner*—Ernest R. Purser

*Attorney, Agent, or Firm*—Head, Johnson & Chafin

[57] ABSTRACT

A method of extracting hydrocarbon from an underground strata, wherein the hydrocarbon has high in situ viscosity, by the steps of forming a vertical access hole from the earth's surface to a point below the strata, the diameter of the access hole being sufficient to permit passage of workmen and machinery, mining an elongated horizontal shaft from the vertical access hole under the strata, establishing at least one drilling station in the horizontal shaft, drilling upwardly from the drilling station a plurality of wells into the hydrocarbon strata, the wells being spaced apart and preferably drilled so as to be substantially vertical in the hydrocarbon strata, injecting a viscosity reducing agent into one or more of the wells to reduce hydrocarbon in the strata to free flowing liquid, withdrawing the free flowing hydrocarbon from the strata through one or more of the wells, and pumping the withdrawn hydrocarbon to the earth's surface.

6 Claims, 12 Drawing Figures

MINE ENHANCED HYDROCARBON RECOVERY TECHNIQUE

BACKGROUND AND OBJECTS OF THE INVENTION

Large quantities of petroleum exist in the United States and many other parts of the world which are so viscous that they cannot be recovered using systems which are employed for normal petroleum production. These highly viscous reserves of petroleum are often found in sandstone stratas and because of the high viscosity of the petroleum in the sandstones, such formations are commonly referred to as tar sand. The petroleum in the tar sand may vary from extremely viscous liquids to solids.

Much work has been done towards finding means of recovering the petroleum from tar sands operating from the earth's surface. The general technique is to attempt to change the in situ viscosity of the petroleum in the tar sands to the point where it will flow into a well and can be pumped to the earth's surface. Among the types of endeavors to recover petroleum from tar sands include the injection of solvents, the injection of steam or hot water, and heating the petroleum by in situ combustion. All of these techniques have enjoyed some measure of success when the circumstances are right. However, all efforts to date have not been successful in removing substantial quantities of petroleum from tar sands, and therefore, an improved means needs to be devised so that these large reserves of petroleum can be made available.

It is therefore an object of this invention to provide an improved means of recovering viscous petroleum products from an underground strata. More particularly, an object of this invention is to provide a method of recovering petroleum from an underground strata wherein the in situ viscosity of the petroleum prohibits the petroleum from freely flowing to a well for pumping to the earth's surface, the method including mining shafts below the hydrocarbon bearing strata to provide drilling stations wherein a multiplicity of wells may be drilled upwardly into the petroleum bearing strata, and including improved means of changing the viscosity of the petroleum in the strata so that it can be pumped to the earth's surface. Other objects of the invention include: the development of a mined enhanced recovery process using drilled shafts for access; development and operation for removal of petroleum from positions beneath the hydrocarbon bearing strata; providing methods of multiple point injection of viscosity reducing material and withdrawing hydrocarbons having improved viscosity from a single drilling station; a method of gravel packing of injection or producing wells; and a method of injecting viscosity improving agents and production of petroleum from a common well bore.

These objects, as well as other and more specific objects of the invention will be understood from the following description and claims, taken in conjunction with the attached drawings.

SUMMARY OF THE INVENTION

A method of extracting petroleum from an underground strata having viscous hydrocarbons therein. The method includes first forming a vertical access hole from the earth's surface to a point below the strata. The diameter of the vertical access hole must be sufficient to permit passage of workmen and machinery. Next, a horizontal shaft is mined from the vertical hole beneath the strata. While the method can be practiced utilizing a single horizontal shaft, the preferred arrangement includes two or three horizontal shafts mined parallel to each other and connected with horizontal connecting shafts spaced apart from each other to provide, in essence, a grid of horizontal shafts beneath the structure. Whether one or more horizontal shafts are utilized, at least one drilling station is provided, however, preferably a plurality of drilling stations are utilized. From each drilling station at least one but preferably a plurality of wells are drilled into the strata. The wells are drilled directionally from the drilling station but in a manner such that the wells preferably enter the lower surface of the hydrocarbon strata substantially vertically so that the wells can be drilled upwardly through the hydrocarbon strata in vertical and spaced apart alignment. After the wells are drilled upwardly from the shaft, a viscosity reducing agent is injected through one or more of the wells in each drilling location to reduce the viscosity of the petroleum in the strata. Viscosity reducing agents can include: steam, hot water, solvent, or compressed air or oxygen to sustain in situ combustion. Regardless of the viscosity reducing agent utilized, the viscosity of the hydrocarbon in the formation is reduced to the point where hydrocarbon becomes free flowing. One or more wells from each drilling station is used to withdraw the free flowing hydrocarbons which can then be collected from each drilling station and pumped to the earth's surface. In addition to the access shaft, one or more additional shafts are preferred providing safety exits as well as ventilation. In addition to the basic concept for enhancing the recovery of high viscosity petroleum, methods are provided for completing the drilled wells from each drilling station, including a method of gravel packing the tubing in a drilled hole.

DESCRIPTION OF THE VIEWS

DETAILED DESCRIPTION OF THE PREFERRED EMBODIMENT

Figure 1:
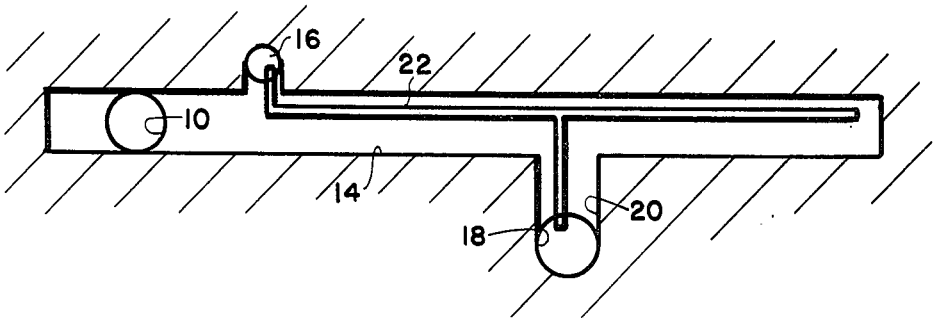
FIG. 1 is a plan view of a layout for mined enhanced recovery of petroleum showing the figuration of a tunnel positioned beneath a petroleum bearing strata and showing the location of shafts which extend from the earth's surface to which the tunnel is connected.
Figure 2:
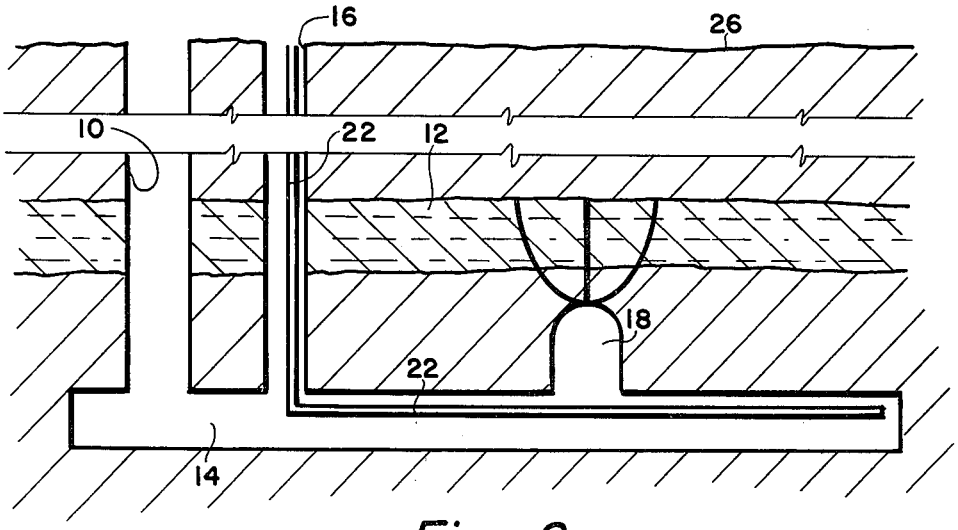
FIG. 2 is an elevational view, shown partially cut away, of the single tunnel arrangement of FIG. 1. The elevational view is not taken with reference to a plane of FIG. 1 but shows the features as if they were in a common vertical plane.

Referring first to FIGS. 1 and 2, a simplified method of practicing the invention is illustrated. First, a large diameter shaft 10 is drilled from the earth's surface to a point below a petroleum bearing strata 12. The depth of shaft 12 will depend upon the various parameters of the particular production site, however, in most instances it will be desirable that the shaft extend to at least 100 feet below the bottom of the petroleum bearing strata 12. Upon completion of shaft 10, men and machinery are lowered through the shaft to the bottom and a tunnel 14 is mined horizontally below the production strata 12. In order to provide for ventilation and an emergency exit, a second ventilation shaft 16 is drilled providing communication with tunnel 14.

A drilling station 18 is next provided having communication with tunnel 14 by means of a connecting tunnel 20. Ventilation support conduits 22 as well as conduits for removing petroleum products or the introduction of viscosity reducing agents can be carried in ventilation shaft 16 and tunnel 14.

Figure 9:
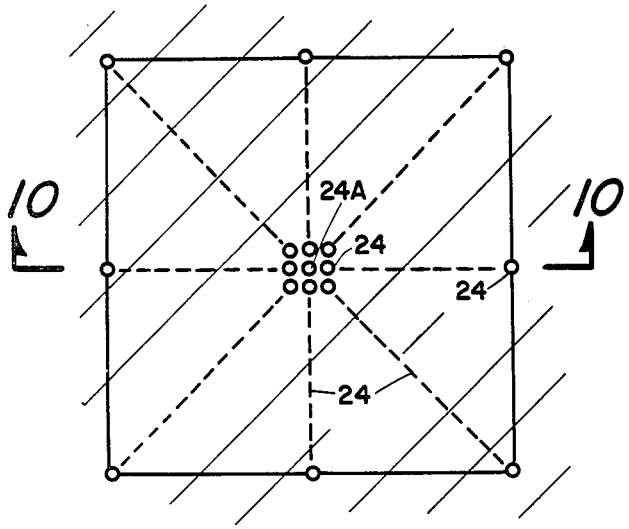
FIG. 9 is a plan view illustrating the well placement of nine wells drilled directionally from a single drilling location.
Figure 10:
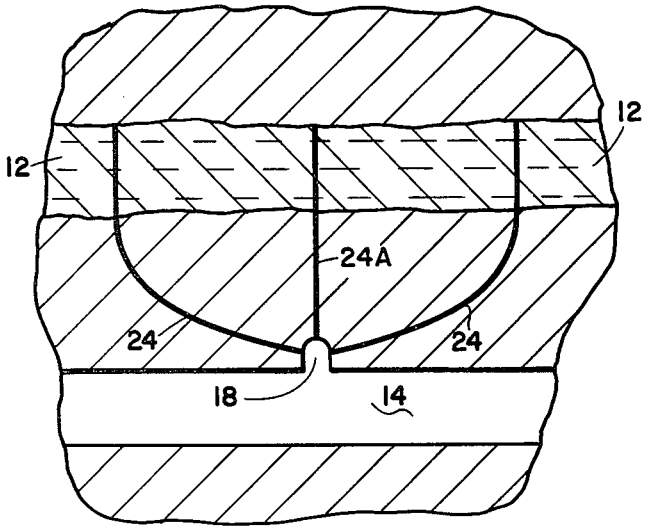
FIG. 10 is an elevational view showing the orientation of wells drilled directionally from a single drilling location to provide a plurality of wells spaced apart from each other in the petroleum producing formation.

From drilling station 18 a number of wells may be drilled upwardly into the producing formation as illustrated in FIGS. 9 and 10. Each well 24 is directionally drilled from production station 18 except a well 24A which is drilled directionally vertically from the production station. Drilling wells 24 and 24A from below the formation upwardly can be accomplished more rapidly than drilling downwardly into the earth since gravity assists in removal of the drilled chips, enabling the drilling bit to penetrate faster into the earth's structure.

FIGS. 9 and 10 illlustrate the arrangement wherein nine wells may be drilled upwardly from a single drilling station 18. The wells may be spaced apart as desired according to the type of recovery technique which is to be employed in transforming the petroleum material in the production strata 12 into a free flowing liquid. Typically the wells 24 may be approximately 165 feet apart. The directional drilling of the wells is conducted in a way so that the wells enter the bottom of the production formation 12 in a vertical direction and pass vertically upwardly to the top of the production formation.

Figure 11:
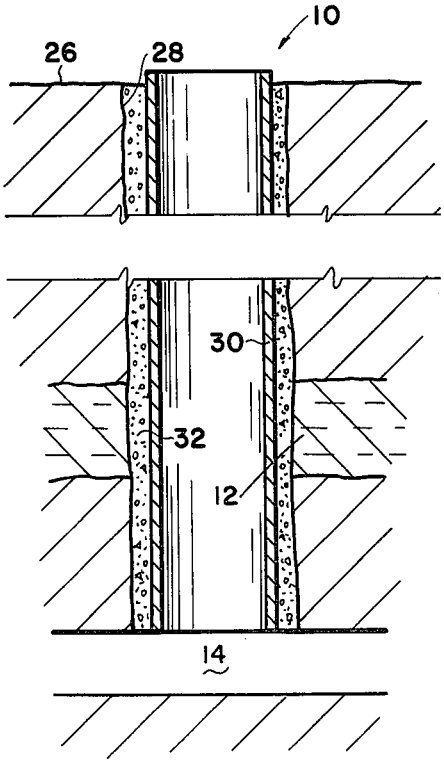
FIG. 11 illustrates the manner in which the drill shaft connecting with the underground mine is sealed off by means of a large diameter casing.

FIG. 11 illustrates how each shaft 10 is formed. From the earth's surface 26 a large diameter type bore hole 28 is first drilled downwardly in the earth past the petroleum bearing strata 12 to the depth where the primary tunnel 14 is to be constructed. To prevent cave-ins of the bore hole 28, prevent water leakage, to seal the production formation 12, and to facilitate the use of the shaft for moving material up and down, a casing 30 is positioned in the borehole and sealed with cement 32.

Figure 3:
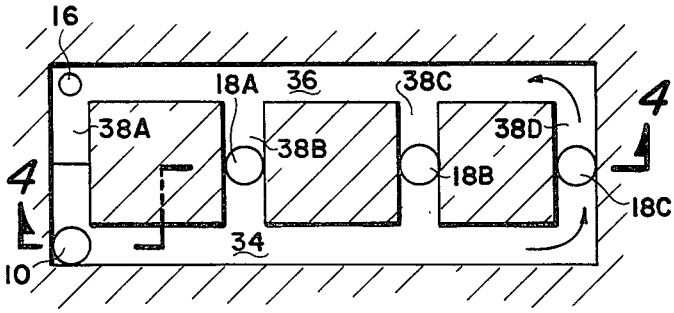
FIG. 3 is a plan view of a recovery system utilizing two main tunnels and showing connecting tunnels providing for three drilling stations.
Figure 4:
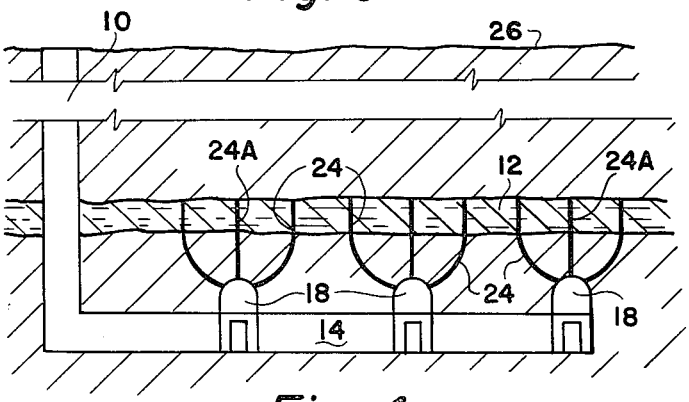
FIG. 4 is an elevational view of the arrangement of FIG. 3 taken along the line 4—4 of FIG. 3.

While the arrangements of FIGS. 1 and 2 illustrate a simplified embodiment of the method of this invention, this arrangement has some limitations as far as safety is concerned, and for this reason it is most preferable that a different tunnel arrangement be utilized. FIGS. 3 and 4 illustrate a double tunnel or double entry system which complies with present mining regulations. As shown in FIG. 3 a first main tunnel 34 is constructed. Spaced apart and parallel from it, and on the same elevation, a second main tunnel 36 is mined. Connecting tunnels 38A, B, C, and D extend between the main tunnels 34 and 36. Main shaft 10 and ventilating shaft 16 thereby communicate with the two main tunnels 34 and 36 and all the connecting tunnels. The connecting tunnels 38B, 38C, and 38D provide ideal places for the location of drilling stations 18A, 18B, and 18C.

Figure 5:
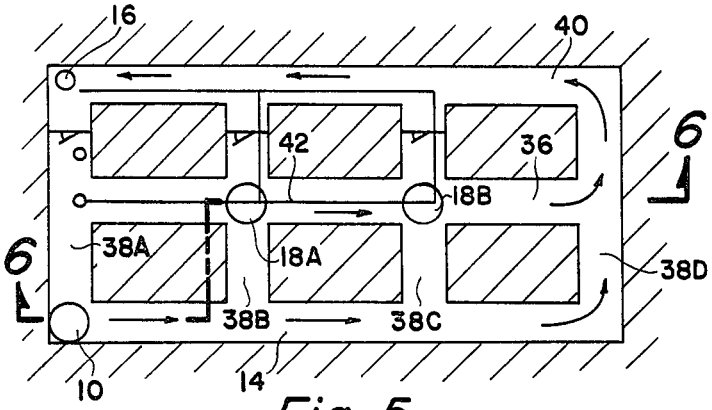
FIG. 5 is a plan view of the mining system using three main tunnels with connecting tunnels.
Figure 6:
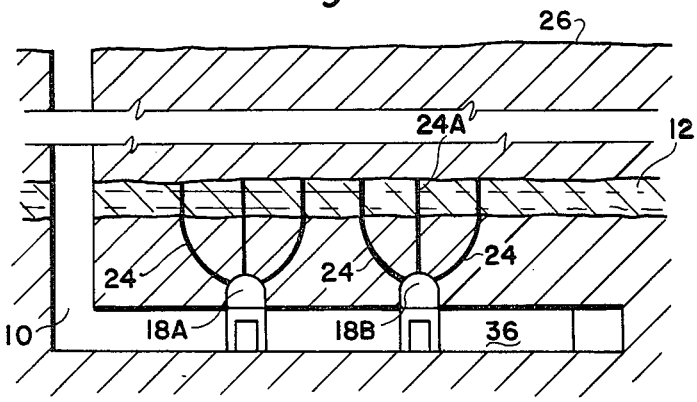
FIG. 6 is an elevational view of the plan of FIG. 5 taken along the line 6—6 of FIG. 5.

FIGS. 5 and 6 show a mining layout employing, in addition to main tunnel 14, a second main tunnel 36, and a third main tunnel 40. Connecting tunnels 38A, B, C and D are employed connecting the three main tunnels together. Drilling Stations 18A and 18B are located in the connecting tunnels 38B and 38C, and if desired, an additional drilling station may be positioned in connecting tunnel 38D. In the arrangement of FIG. 5, the central tunnel 36 serves for the location of piping 42 required for injection of a viscosity reducing agent into the petroleum bearing strata 12 and also the piping can serve for removal of produced fluids. The central tunnel 36 also serves a return air conduit. Tunnels 14 and 40 are used for traffic and development. It can be seen that the arrangement would as well permit the use of the central tunnel 36 for development and for intake air while the third main tunnel 30 serves as a return air entry. The selection of a development plan whether that illustrated in FIGS. 1, 3, and 5, or any similar such system will be determined by circumstances governing a particular site which will include the mining rules of the jurisdiction controlling, the cost of mining, and the strength of the rock surrounding the petroleum bearing strata 12, and the nature of the production bearing strata.

Referring again to FIGS. 9 and 10, as previously stated, each well 24 should penetrate the production bearing formation 12 in substantially vertical orientation. To assist in accomplishing this, each well, except vertical well 24A, will be deviated from the vertical, perhaps at an angle of approximately 30° from the horizontal. After drilling about 35 feet, a joint of casing will be grouted into the hole to serve as a collar casing. After the first casing is set and the grout has hardened, all further operations will be conducted through a rotating blow-out preventer (not shown). This will serve two useful purposes, one of which is to accumulate all drilling fluids and cuttings into a pipeline, keeping the site of drilling clean and dry. The second is to prevent venting any hydrocarbon fluids at the drilling station. Cuttings and circulating fluid from the annulus between the drilling string and bore hole will be conducted to a point of separation wherein any hydrocarbon vapors can be accumulated in a vacuum hood (not shown) and vented to the surface.

Drilling wells 24 and 24A can be accomplished such as by the use of a dynadrill, turbodrill, or electrodrill. These known types of drilling devices permit the greatest amount of directional control by providing all required rotational force at the bit rather than through the entire drill string. The bit will be deflected to follow generally a curvilinear path as illustrated so that it will encounter the production formation 12 essentially in a true vertical direction. At the first penetration of the production formation 12 the drilling assembly will be withdrawn from the hole and appropriate sized casing placed in the hole. The casing will be grouted in place by pumping neat cement grout into the annular space between the casing and the drill hole through a wellhead (not shown) with the grout rising from the collar of the hole to the top of the casing, and when grout reaches the top of the casing, grouting will be halted and operation stopped until the grout has reached its desired degree of set. After the grouting is set, drilling will be resumed till the hole has been extended preferably to the top of the production formation 12.

Figure 8:
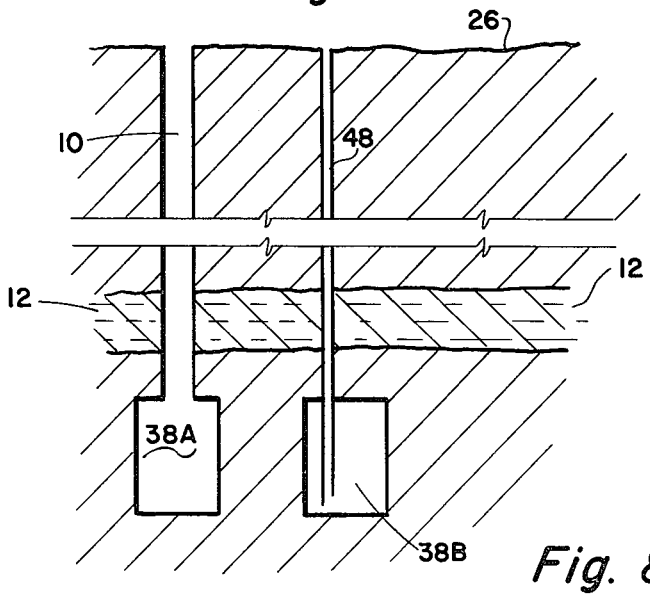
FIG. 8 is an elevational view taken along the line 8—8 of FIG. 7.
Figure 7:
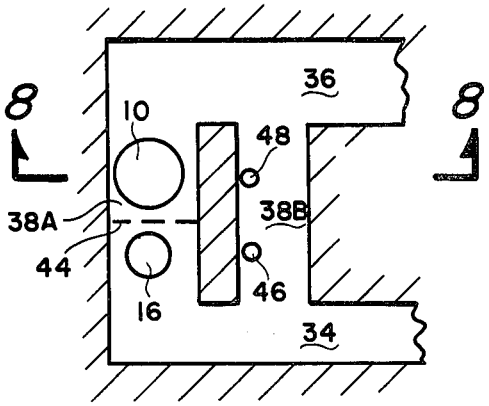
FIG. 7 is a segmented plan view of a mining layout employing two main tunnels and showing the arrangement for employing two shafts and two service bore holes.

FIGS. 1, 3, and 5 show mine layouts utilizing single main shaft 10 and a ventilation shaft 16. FIGS. 7 and 8 show a partial layout employing first main shaft 10 and a vent shaft 16 spaced in close proximity to each other. In this arrangement a curtain 44 may be employed between shafts 10 and 16 to force ventilation throughout the balance of the tunnel system. Additional small diameter bore holes may be provided such as an injection fluid bore hole 46 and a produced fluid bore hole 48. As previously stated, when each well 24 or 24A is drilled from a drilling station, it is lined with casing up to the bottom of the production strata 12. In cases where the production strata is unconsolidated, or where in situ combustion is contemplated or the injection of a material which may have detrimental effect upon the cementing material in the tar sands exist, each well may be gravel packed rather than using cement grout to maintain a casing in place.

Figure 12:
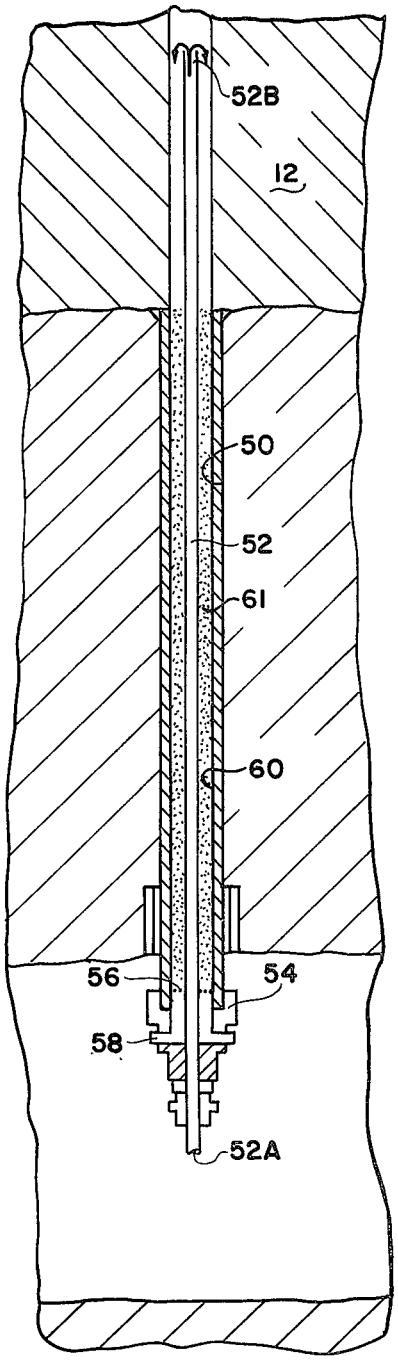
FIG. 12 illustrates an elevational view of a typical drill hole illustrating the means of gravel packing of the tubing in the drilled hole.

Referring to FIG. 12, a method of gravel packing will be described. After a drilled bore hole 50 is completed to the top of the production formation 12 a tubing 52 is inserted in the borehole 50 with centralizers (not shown) appropriately spaced to maintain the tubing in the center of the hole. A slurry of graded sand or fine gravel, suspended in a time-sensitive gel of water and an organic gum such as gaurr gum, is injected into the tubing lower end 52A. The slurry will flow out the top end 52B of the tubing and fall back in the bore hole 50 down in the wellhead 54. A screen 56 in the wellhead strains the sand or gravel from the slurry, and the liquid phase can pass out through opening 58 in the wellhead to be recirculated to carry additional sand or gravel into tubing inlet 52A. The gravel packing 60 will build up in the annular area between the exterior of the tubing 52 and the bore hole 50 until it is entirely packed with gravel. When the packing has reached the top of tubing 52 circulation of the slurry will be continued for a certain length of time to further compact the packing until no additional solids can be circulated. The carrier fluid will be circulated until the gelling agent breaks down and viscosity of the fluid reaches that of the original fluid, either oil or water. The packing and tubing then can be drained of the carrier fluid and the well is ready for operation. If desired, the packing can be terminated when it has filled the annulus to the bottom of the hydrocarbon formation 12, as illustrated.

PRODUCING OPERATION

One of the advantages of the method of this invention is the ability to simultaneously inject a viscosity reducing agent into a producing formation 12 and simultaneously withdrawing production from the same well, at least in the early stages of the well. Assume that the specific gravity of the petroleum in production formation 12 is greater than 1, that is, that the API gravity is less than 10 which in turn means that the fluid is heavier than water. The viscosity reducing agent may be such as steam, and the steam may be injected into a well completed as illustrated in FIG. 12, through tubing 52. The steam will contact the formation 12 first at the top. If sufficient heat is absorbed by the contained hydrocarbon in formation 12 to cause it to become mobile, it will flow downwardly in the annular space between the tubing and the bore hole 50 with water condensate rising to the top of the hydrocarbons because of the difference in the specific gravity. The hydrocarbons can then be drawn off from the annulus for accumulation and pumping to the surface. A sensing device (not shown) based on specific gravity differences, diolectric constant differences, electrical capacity differences, or viscosity differences can be placed in the fluid circuit and when water begins to appear in the well effluent, then an annular valve will be closed. Continued injection of steam will recharge the well annulus with liquid hydrocarbon. The injection of steam could also be supplemented with electrical heaters (not shown) attached to the well tubing to maintain hydrocarbon in a fluid state and also to assist in the segregation of the injected water in the fluid hydrocarbon.

Where the petroleum content of strata 12 has a specific gravity lower than that of water, which means that the API gravity is greater than 10, then the injection of the steam can be at the annulus with the hydrocarbons being withdrawn from the top of the strata 12 through tubing string 52. The same type of detecting system may be employed to terminate withdrawal of the fluid when water appears in the effluent until sufficient heat is then introduced by way of the steam to create additional free-flowing hydrocarbon.

Hydrocarbons produced may be withdrawn from the wells through insulated pipe to a central collection tank (not shown) where additional heat can be applied if necessary and the accumulated hydrocarbons pumped to the surface. All systems must be completely closed so that no hydrocarbon vapors or liquids escape underground and thereby cause potential fire or asphixiation hazards.

When wells are produced according to the above method, ultimately the formation adjacent to a well bore will become sufficiently depleted of hydrocarbon that the steam injected will condense and flow out of the withdrawal point without bringing substantial quantities of hydrocarbons with it. When this situation develops, the operation can be changed to a conventional enhanced recovery operation with certain wells converted to injection services exclusively and other wells converted for production exclusively. The same monitoring approaches will be followed so that when water or the other injected viscosity reducing fluid appears in excessive quantities in a producing well it will be automatically shut down to allow the re-establishment of gravitational equilibrium for continued production.

Steam can be generated at the earth's surface and carried through conduits either in shaft 10 or ventilating shaft 16, through injection fluid bore hole 46 as illustrated in FIG. 7. This will minimize the underground space requirement to support the overall operation and eliminate the need of steam generating equipment underground.

While the method of production of wells utilized in the practice of this invention has been discussed wherein steam is used, it can be seen that the same general techniques may be employed if a solvent is used to reduce viscosity or if hot water rather than steam is utilized, or if in situ combustion is initiated in the petroleum bearing strata in which case air or oxygen is injected as the viscosity reducing agent to sustain the combustion.

While the invention has been described with a certain degree of particularity, many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of extracting from an underground strata hydrocarbons having high in situ viscosity comprising:

(1) forming a vertical access shaft from the earth's surface to a point below the strata, the diameter of the vertical access shaft being sufficient to permit passage of workmen and machinery;

(2) mining a horizontal tunnel from the vertical access shaft to a position under the strata;

(3) establishing at least one drilling station in said horizontal tunnel;

(4) drilling upwardly from each drilling station a plurality of wells into the strata; the drilling including directionally drilling the wells so that each well enters the bottom of the strata spaced apart from the other wells, and each well penetrates the strata substantially vertically and extends to the top of said strata;

(5) injecting a viscosity reducing agent through at least one well to reduce hydrocarbons in the strata to free flowing liquids;

(6) withdrawing the free flowing hydrocarbons from the strata through at least one of the wells; and (7) pumping the withdrawn free flowing hydrocarbon to the earth's surface.

2. The method of extracting hydrocarbons according to claim 1 including the step of:

drilling a second vertical access shaft from the earth's surface communicating with the horizontal tunnel, the diameter of the second shaft being sufficient to permit the passage of workmen therethrough, the second vertical access shaft serving as an air ventilation shaft.

3. The method of extracting hydrocarbons according to claim 1 wherein step (2) includes mining two spaced apart paralleled horizontal main tunnels beneath the hydrocarbon strata and a plurality of spaced apart horizontal connecting tunnels communicating between the main tunnels, and wherein step (3) includes establishing a drilling station in at least some of the connecting tunnels.

4. A method of extracting hydrocarbons according to claim 1 wherein step (2) includes mining three spaced apart paralleled horizontal main tunnels beneath the hydrocarbon strata and a plurality of spaced apart horizontal connecting tunnels communicating perpendicularly between the three main tunnels and wherein step (3) includes establishing a drilling station in at least some of the connecting tunnels.

5. A method of extracting hydrocarbons according to claim 1 includes after step (4):

positioning a casing in a drilled well, the casing terminating at the top of the hydrocarbon strata;

positioning tubing in the drilled well within the casing providing an annulus between the interior of the casing and the exterior of the tubing, the top of the tubing extending within the hydrocarbon strata;

injecting a viscosity reducing agent into end of said tubing and said annulus; and withdrawing liquified hydrocarbon from the other of said tubing and annulus.

6. A method of extracting hydrocarbons according to claim 1 including after step (4):

positioning a casing in a drilled well, the casing terminating at the top of the hydrocarbon strata;

positioning tubing within the casing, the tubing having centralizers thereon;

pumping a slurry of gravel through the tubing from the lower end thereof, the slurry passing out the upper end of the tubing and falling back downwardly into the annular area exterior of the tubing;

straining the liquid phase from the slurry and the drilling station to allow the gravel to accumulate in the annular area; and continuing the pumping of slurry until the complete annular area is packed with gravel.

* * * * *